US006568223B1

(12) United States Patent
Morita

(10) Patent No.: US 6,568,223 B1
(45) Date of Patent: May 27, 2003

(54) GUIDE MECHANISM OF KNITTING MEMBER AND COMPOUND NEEDLE ASSEMBLING THE GUIDE MECHANISM THEREIN

(75) Inventor: Toshiaki Morita, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/089,091

(22) PCT Filed: Oct. 25, 2000

(86) PCT No.: PCT/JP00/07483

§ 371 (c)(1),
(2), (4) Date: Apr. 11, 2002

(87) PCT Pub. No.: WO01/31101

PCT Pub. Date: May 3, 2001

(30) Foreign Application Priority Data

Oct. 27, 1999 (JP) ..... 11-305484

(51) Int. Cl.[7] ..... D04B 7/04

(52) U.S. Cl. ..... 66/120; 66/116; 66/120; 66/123

(58) Field of Search ..... 66/116, 120, 123

(56) References Cited

U.S. PATENT DOCUMENTS 1,673,634 A * 6/1928 Page ..... 66/120
3,584,481 A * 6/1971 Hayashi ..... 66/120
5,937,673 A * 8/1999 Shima ..... 66/120
6,233,977 B1 * 5/2001 Schuler et al. ..... 66/120
6,389,848 B1 * 5/2002 Kyoutani ..... 66/120
6,422,045 B1 * 7/2002 Morita et al. ..... 66/120

FOREIGN PATENT DOCUMENTS

| | | |
|---|---|---|
| FR | 2652593 A | 9/1990 |
| GB | 2237035 A | 9/1990 |
| IT | 1242058 A | 9/1990 |
| JP | 1-54459 B | 11/1989 |
| JP | 4-66941 B | 9/1990 |
| JP | 2946323 B | 7/1999 |

* cited by examiner

*Primary Examiner*—Danny Worrell
(74) *Attorney, Agent, or Firm*—Rothwell, Figg, Ernst & Manbeck

(57) ABSTRACT

A first knitting member 5 has a fork portion 38 extending forwardly formed in an upper portion of a side wall(s) of the first knitting member at an accommodation groove forming portion 33 thereof where the accommodation groove 32 for accommodating the second knitting member 7 is formed, while also the second knitting member 7 has a guiding portion 55 formed to be curved outwardly so that its upper surface can confront a lower surface of the fork portion 38 formed on the side wall(s) of the first knitting member 5, so that while the second knitting member 7 is moved relative to the first knitting member 5, the guiding portion 55 of the second knitting member 7 is guided into a space formed under the fork portion 38 of the first knitting member 5 and supported by the fork portion 38 during at least part of the relative movement.

7 Claims, 6 Drawing Sheets

GUIDE MECHANISM OF KNITTING MEMBER AND COMPOUND NEEDLE ASSEMBLING THE GUIDE MECHANISM THEREIN

CROSS REFERENCE TO RELATED APPLICATION

This application is a 35 USC 371 National Phase Entry Application from PCT/JP00/07483, filed Oct. 25, 2000, and designating the U.S.

TECHNICAL FIELD

The present invention relates to a knitting member guide mechanism. More particularly, the present invention relates to a guide mechanism for guiding second knitting members, which are accommodated in accommodation grooves formed in first knitting members so as to be movable relative to the first knitting members, by means of the first knitting members which are accommodated in a number of knitting member accommodation grooves formed in side-by-side relation in accommodation beds so as to be freely advanced and retracted with respect to a needle bed gap, and to a compound needle incorporating the same mechanism therein.

BACKGROUND ART

The knitting members referred to in the specification include a knitting needle, a sinker, a transfer jack, a selector, a select jack, a yarn guide, a loop presser and components thereof mounted on accommodation beds, such as a needle bed, a sinker bed and a transfer jack bed, of a knitting machine for knitting a fabric. In the following, reference will be given to the guide mechanism of a knitting needle, taking a compound needle, in particular, as an example of the knitting member. It is added, however, that the knitting members are not limited to the compound needle.

The applicant of this application previously proposed a compound needle described in Japanese Patent Application Laid-open (Unexamined) No. Hei 3 (1991)-119160. This relates to a compound needle comprising a needle body having a needle hook at a front end thereof and a slider having a tongue at a front end thereof and accommodated in a slider groove formed in the needle body so as to freely advance and retract therealong. In this compound needle, a guide surface, formed on the bottom of the slider groove, to contact with a forefront portion of the slider is formed as a cam surface via which the slider, when advanced with respect to the needle body, is raised to bring the tongue into abutment with the needle hook, and a slider floatation restrainer (guide mechanism) is provided on the needle body side via which the slider, when retracted, is lowered to return the tongue of the slider to its original retracted position in the slider groove, whereby a front end portion of the slider is held in sandwich relation between the slider floatation restrainer and the cam surface, so as to allow the slider to be guided by the needle body.

In this compound needle, it is necessary that the slider floatation restrainer serving to guide the slider is disposed right above the slider groove on the needle body side. For this reason, when the slider groove is formed by a cutting process, an appropriate working method must be taken to prevent the slider floatation restrainer from being cut. On the other hand, without recourse to the cutting process, it would be necessary that a cam piece and the like is fixedly mounted on that part, then leading to increased number of processes for producing the components and thus increased production costs.

The provision of the guide mechanism permits the yarn fed to the needle hook to be prevented from being caught on the tongue, and as such can allow the yarn to be surely captured by the needle hook. This behavior of the tongue permits the lowering of a throat part of the needle body, and as such can provide reduced frictional resistance against a loop held on the needle when the needle is advanced and retracted and thus provide reduced load on the knitting yarn.

The applicant of this application also proposed a compound needle described in Japanese Patent Application Laid-open (Unexamined) No. Hei 11 (1999)-152664. This relates to a so-called slide needle or a compound needle of the type that the slider comprises two thin plate blades having tongues at front ends thereof, the blades are accommodated in an overlapped relation in a blade groove formed in the needle body, so that when the needle body and the slider are moved relative to each other, a needle hook are opened and closed by the tongues, and further the tongues are permitted to advance beyond the needle hook to perform transference of a loop.

It is an object of the present invention to provide a knitting member guide mechanism for guiding a second knitting member, which is accommodated in an accommodation groove formed in first knitting member and is constructed to be movable relative to first knitting members, by means of the first knitting member, by a simpler process and with high reliability. The relation between the first knitting member and the second knitting member is, for example, just like the relation between the needle body and the slider, as noted above.

It is another object of the present invention to provide a compound needle incorporating this knitting member guide mechanism therein. It is still another object of the present invention to provide a slider guide mechanism of a compound needle of the type that the slider of the compound needle comprises two thin plate blades and these two blades are fitted in an overlapped relation in an accommodation groove formed in the needle body. It is a further object of the present invention to provide a compound needle that presents improved yarn feed conditions.

DISCLOSURE OF THE INVENTION

The present invention provides a knitting member guide mechanism comprising a first knitting member, such as a knitting needle, which is accommodated in each of a number of knitting member accommodation grooves arranged side by side on an accommodation bed, so as to be freely advanced toward and retracted from a needle bed gap, and a second knitting member which is accommodated in an accommodation groove formed in the first knitting member to extend longitudinally of the first knitting member, so as to be movable relative to the first knitting member, wherein the first knitting member has a fork portion extending forwardly formed in an upper portion of at least one of side walls of the first knitting member at an accommodation groove forming portion thereof where the accommodation groove for accommodating the second knitting member is formed, while also the second knitting members has a guiding portion formed to be curved outwardly so that its upper surface can confront a lower surface of the fork portion formed on the at least one side wall of the first knitting member, so that while the second knitting member is moved relative to the first knitting member, the guiding portion of the second knitting member is guided into a space formed under the fork portion of the first knitting member and supported by the fork portion during at least part of the relative movement.

Preferably, the lower surface of the fork portion is formed as a slanted cam surface declining rearwardly, so that when the second knitting member is retracted with respect to the first knitting member in the relative movement therebetween, the upper surface of the second knitting member is brought into abutment with the cam surface to lower the second knitting member.

In general, the upper surfaces of the second knitting member accommodated in the accommodation groove of the first knitting member are free from the intersection with the upper surfaces of the side walls of the first knitting member in an accommodation groove forming portion thereof in the course of relative movement therebetween and, therefore, the second knitting member cannot be vertically guided by that portion of the first knitting member. On the other hand, according to the present invention, since the first knitting member has the fork portion extending forwardly formed in the upper portion of at least one of the side walls of the first knitting member, while also the second knitting member has the guiding portion formed to be curved outwardly so that its upper surface can confront the lower surface of the fork portion formed on the at least one side wall of the first knitting member, the curved portion of the second knitting member is allowed to overlap with the lower surface of the first knitting member in the space under the fork portion of the first knitting member and thus the vertical position of the second knitting member is controlled to a specified position.

The present invention provides a compound needle whose knitting members comprise a first knitting member and a second knitting member which are in the form of a needle body having a hook at its front end and a slider having tongues at its front end, respectively, wherein an accommodation groove formed in the needle body has depth to accommodate the tongue therein when the slider is in its retracted position and raise and displace the tongue toward the hook when the slider is advanced, and wherein the needle body forming therein the accommodation groove has a guide surface formed on a lower surface of a fork portion provided in at least one of side walls of the needle body, while on the other hand, the slider is provided, on its upper surface, with a guiding portion which is formed to be curved outwardly so as to confront the guide surface of the fork portion, so that when the slider is retracted, the upper surface of the guiding portion of the slider is brought into engagement with the guide surface formed in the fork portion to guide the slider back to its retracted position.

Preferably, the slider comprises blades comprising two thin plates having tongues at their front ends, the blades are accommodated in the accommodation groove of the needle body, the fork portion is formed in each of the side walls of the needle body forming therein the accommodation groove, and the blades are formed to be curved toward the side walls of the needle body on the side on which the blades are slidably contactable with the side walls of the needle body, respectively, so that upper surfaces of the blades confront their respective lower surfaces of the fork portions.

The blades are connected to the slider body supported on the needle body at top portions thereof.

Preferably, the blades are connected to the slider body in such a manner that front end portions of the tongues are biased downwardly in the state in which the blades are accommodated in the accommodation groove of the needle body.

According to the present invention, when the slider is advanced in the movement relative to the needle body, the tongues are raised and displaced to close the hook, while coming near to the hook. On the other hand, when the slider is retracted, since the slider is formed to be curved so that the upper surface of the slider accommodated in the accommodation groove can confront the lower surface of the fork portion extending forward formed on the upper portion of the accommodation groove forming portion of the needle body, the upper surface of the curved portion of the slider is brought into engagement with the lower surface of the fork portion of the needle body and thereby the slider is lowered and returned to its original retracted position.

In the case of the slider comprising blades comprising two thin plates having tongues at front ends thereof, the fork portions are provided in both side walls of the needle body forming therein the accommodation groove and also the blades are formed to be curved so that the upper surfaces of the blades can confront those fork portions. In this case, the guiding portions of the needle body formed to confront each other across the accommodation groove and the right and left guiding portions formed in the slider are brought into engagement with each other and thereby the slider is guided to its vertical positions.

The slider is accommodated in the accommodation groove in the state in which a front end portion thereof on the tongue side is biased downwardly and, thus, the slider is moved back and forth in the state in which the front end portion of the blades are always in abutment with the bottom surface of the groove, unless an external force acts on the slider. If there may happen such an occasion that when the slider is retracted after raised and displaced, fibrous dusts and the like get into the accommodation groove to hinder the backward movement of the blades in the state in which the front end portions of the blades are in abutment with the bottom surface of the groove, since the blades are guided by the guide mechanism to forcibly lower the tongues, the blades can be returned to their original retracted positions.

BRIEF DESCRIPTION OF THE DRAWINGS

FIG. 3-A illustrates the state that guiding portions of the blades and guiding portions of the hook member are away from each other; and FIG. 3-B illustrates the state that the respective guide surfaces confront each other, In FIG. 4, FIG. 4-A illustrates the state that the slider is in its retracted position;

FIG. 4-C illustrates the state that the slider is advanced and put in abutment with the hook portion; and FIG. 4-D illustrates the state that the tongue is advanced beyond the hook into its loop-transference position.

BEST MODE FOR CARRYING OUT THE INVENTION

Certain preferred embodiments of the present invention in which a knitting member guide mechanism is applied to a guide for a slider of the compound needle will be described below with reference to the accompanying drawings.

Figure 1:
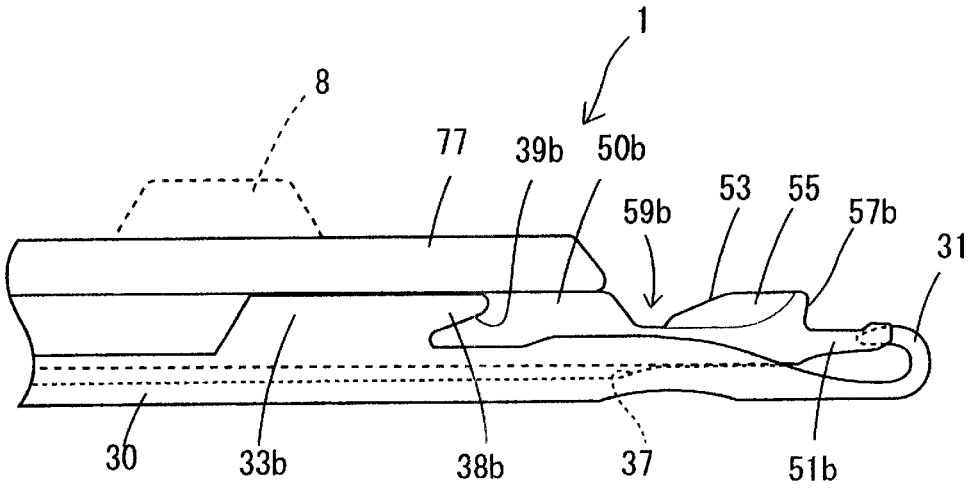
FIG. 1 is a view showing a forefront portion of a compound needle of an embodiment of the present invention which is in the state of being fitted in a needle groove formed in a needle bed.
Figure 2:
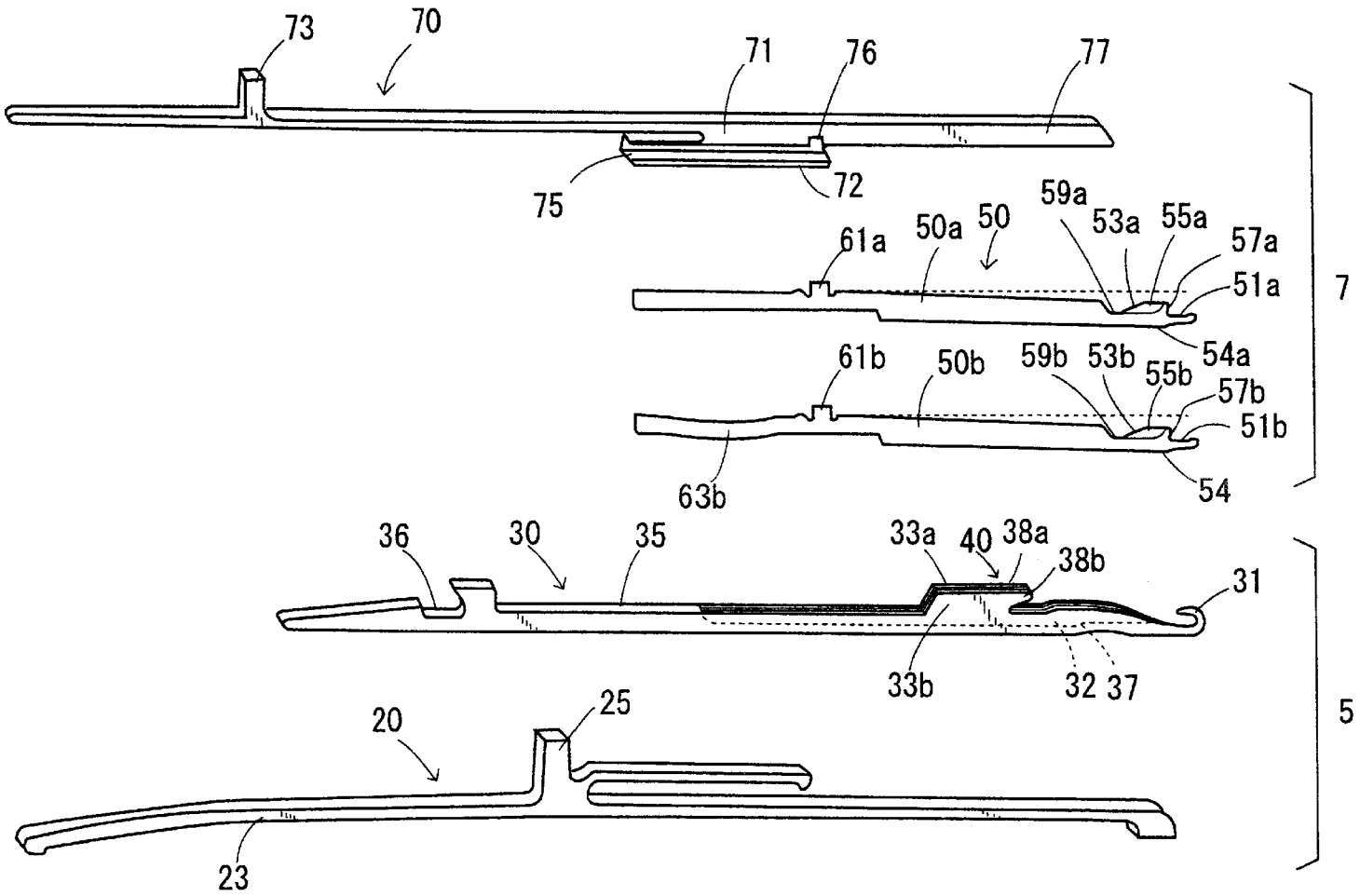
FIG. 2 is a view showing the detail of the respective parts of the compound needle.

FIG. 1 shows a forefront portion of a compound needle 1 which is in the state of being fitted in a needle groove formed in a needle bed not shown, and FIG. 2 shows the detail of the respective parts of the compound needle 1. The compound needle 1 comprises a needle body 5 and a slider 7. The needle body 5 comprises a needle hook member 30 and a jack 20 separate therefrom. These parts of the needle body 5 may be formed as a unit. In the illustrated embodiment, the needle body 5 comprises combination of these parts. The slider 7 comprises blades 50*a* and 50*b* comprising two thin plates and a slider body 70 separate therefrom.

The needle hook member 30 includes a hook portion 31, a groove forming portion 33 for forming a blade groove 32 to accommodate the blades 50*a* and 50*b* of the slider, a center body portion 35 for supporting a lower arm 72 of the slider body 70, and a concave portion 36, provided at a rear end portion of the needle hook member, for connecting a front end of the jack 20, when cited in the order of arrangement from the front end side. The blade groove 32 is so formed that when the slider 7 is in its retracted position, the tongues 51*a* and 51*b* can be accommodated in the blade groove 32, while on the other hand, when the slider is advanced, lower surfaces 54*a* and 54*b* of the blades can be brought into engagement with a cam surface 37 formed on the bottom surface of the groove, to raise and displace the tongues 51*a* and 51*b*, so as to bring them into abutment with the front end of the hook portion 31. The blade groove forming portions 33 has, on upper front portions of right and left side walls 33*a* and 33*b* thereof on the rear side with respect to the tongue accommodation portion, fork portions 38*a* and 38*b* extending forwardly and formed to be integral with their side walls. The fork portions 38*a* and 38*b* have, on lower surfaces thereof, guiding portions 40 comprising cam surfaces 39*a* and 39*b* engageable with upper surfaces of guiding portions 55*a* and 55*b* (mentioned later) formed in the blades 50*a* and 50*b*. The cam surfaces 39*a* and 39*b* are presented in the form of slanted surfaces declining rearward.

The needle hook member 30 and the jack 20 are formed to have thickness identical to each other and slightly smaller than width of the needle groove. The jack 20 has a control butt 25 projecting from around the center of its body, to engage with a cam mounted on a cam carriage (not shown), so as to be operated to advance and retract, so as to make the needle body 5 advance and retract. 23 denotes a curved elastic leg whose front end is abutted with a bottom of the needle groove.

The blades comprise two thin plates 50*a* and 50*b* of generally identical in shape to each other and combined in an overlapped relation and are accommodated in the blade groove 32 of the needle hook member 30. The blades 50*a* and 50*b* have tongues 51*a* and 51*b*, formed at front end portions thereof, to abut with a front end portion of the hook 31. The blades are raised upwardly at portions thereof on the rear side of the tongues, to form shoulder portions 57*a* and 57*b* thereat. At the rear side of the shoulder portions 57*a* and 57*b* are formed concave portions 59*a* and 59*b*. The guiding portions 55*a*, 55*b* are formed between the concave portions 59*a*, 59*b* and the shoulder portions 57*a*, 57*b*. The blades 50*a* and 50*b* have slanted surfaces 53*a* and 53*b* formed at portions thereof on the shoulder side of the concave portions 59*a* and 59*b*, and the slanted surfaces are curved toward the side walls 33*a* and 33*b* of the needle hook member 30 on the side thereof on which the upper surfaces of the slanted surfaces are slidably contactable therewith, respectively, so that they can confront the cam surfaces 39*a* and 39*b* of the fork portions 38*a* and 38*b* formed on the side wall 33*a* and 33*b*. 61 denotes connecting portions, formed on the rear side of the blade groove 32, to connect with the slider body 71.

Figure 3:
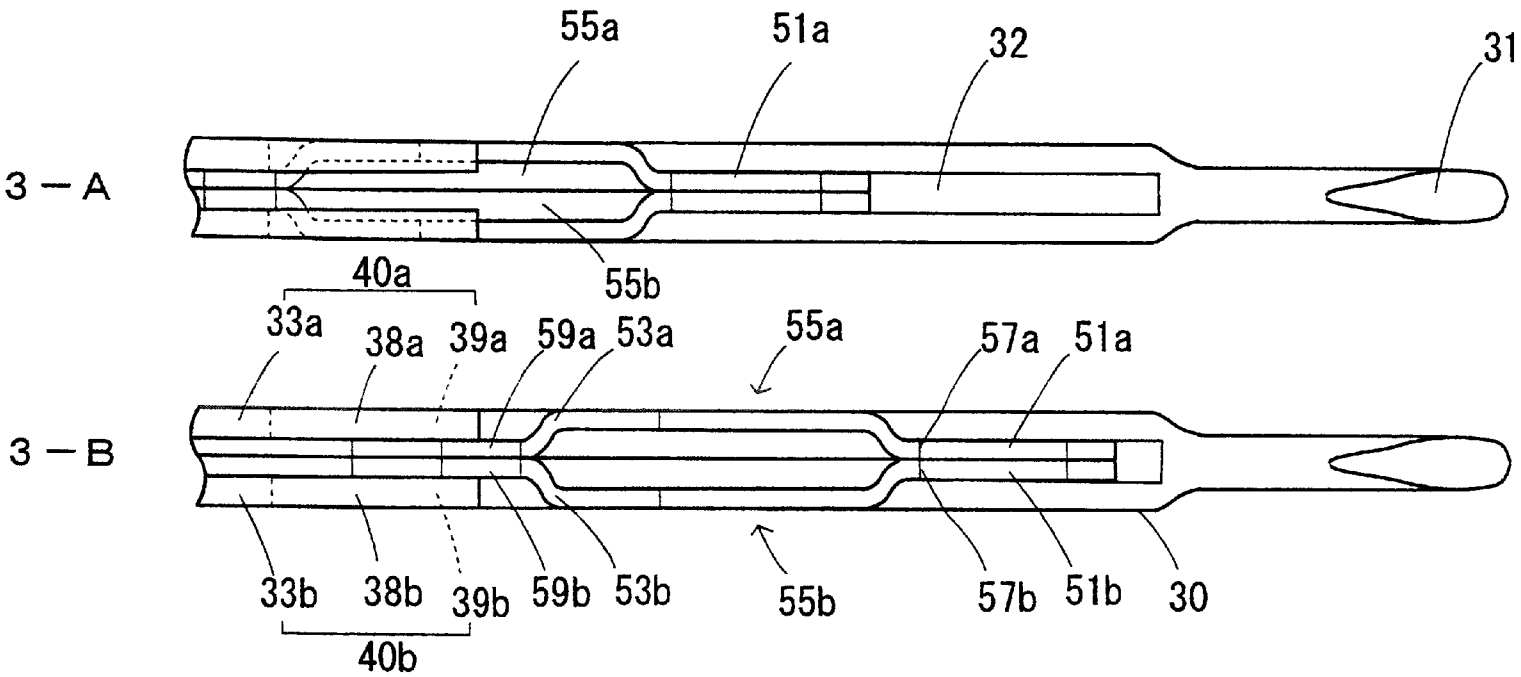
FIG. 3 is an enlarged view, as viewed from the top, of a guide mechanism provided in a hook member and the blades, from which the slider body is removed.

FIG. 3 is an enlarged view, as viewed from the top, of a guide mechanism 40, 55 provided in the hook member 30 and in the blades, from which the slider body 70 is removed; FIG. 3-A illustrates the state that the guide surfaces of the guiding portions 55 of the blades 50 and the guide surfaces of the guiding portion 40 of the hook member 30 confront each other; and FIG. 3-B illustrates the state that the respective guide surfaces are away from each other. As seen from the illustrations, the guiding portion 55 is formed to be curved outwardly to a larger extent at a portion thereof on the concave portion 59 side than at a portion thereof on the shoulder portion 57 side so that the guiding portions can start contacting with the cam surface 39 of the fork portion 38 from the slanted surfaces 53 of the guiding portions 55. This can permit each other's contacting areas to increase to ensure that the blades 50 are guided by the needle hook member 30.

The slider body 70 has thickness identical to that of the needle hook member 30 and has a control butt 73, projected from a rear end portion thereof, for controlling the advancing and retracting motion of the needle hook member. The slider body has a forefront portion 77 extending forward thereof whose lower surface is supported on an upper surface of the blade groove forming portion 33 of the needle hook member 30. 72 denotes a lower arm formed to be branched from the body portion and extended to a space in the center body portion 35 of the needle hook member 30. The lower arm 72 has a longitudinal slot 75 formed by cutting at one side surface thereof and a thru hole 76 formed on the longitudinal slot 75. The connecting portions 61 of the blades are positioned to and fixedly engaged in the thru hole 76 by caulking and the like method. The blades 50 are so formed that their forefront portions are biased to such an extent that lower edges of the blades on the front end side thereof can apply some pressure to the bottom of the blade groove 32 when the blades 50 are in the state of being fitted in the blade groove 32 of the needle hook member 30. The blade 50*b* extending along and located outside of the longitudinal slot 51 is bent at a rear end portion 63*b* thereof so as to be press-contacted with the side wall of the needle groove, so as to prevent the slider 7 from moving awkwardly in association with the advancing and retracting motion of the needle body 5.

8 depicted in a broken line of FIG. 1 denotes a strap for holding the compound needle in its fitted state in the needle groove of the needle bed.

Figure 4:
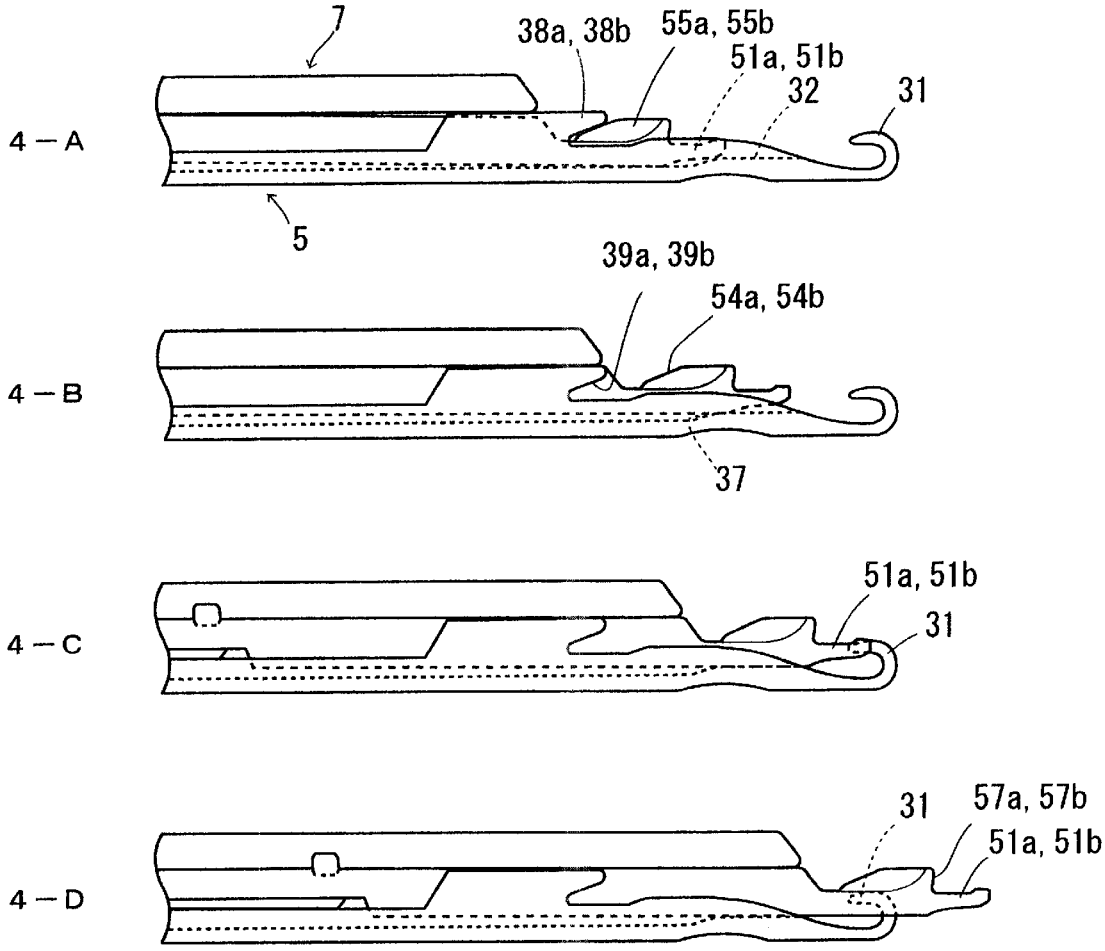
FIG. 4-B illustrates the state that the slider is advanced a little from its retracted position.

Now, operation of the compound needle 1 thus constructed at the open and close of the hook will be described with reference to FIG. 4. Relative movement between the needle body 5 and the slider 7 is shown stepwise in FIGS. 4-A to 4-D. The blades 50 are in contact with the blade groove in the state in which a forefront portion thereof applies some pressure to the bottom of the blade groove (in the state of FIG. 4-A). Thus, while the slider 7 moves relative to the needle body 5 in FIGS. 4-A to 4-D, the blades 50 are moved in the state in which a downward biasing force is always applied to the bottom of the blade groove 32, unless an external force acts on the slider 7.

First, reference is given to the forward movement of the slider 7. FIG. 4-A illustrates the position to which the slider 7 is retracted furthest with respect to the needle body 5. In this position, the tongues 51 are accommodated in the blade groove 32 and the needle hook is fully opened. FIG. 4-B illustrates the state in which the slider 7 is advanced a little from the position of FIG. 4-A toward the needle bed gap. In this state, the lower edges of the blades 50*a* and 50*b* are engaged with the slanted cam surface 37 of the slider groove 32 and thereby the tongues 51*a* and 51*b* are raised and displaced. This rise and displacement accompanies elastic deformation of the blades themselves. FIG. 4-C illustrates the state in which the slider 7 is advanced further and the front ends of the tongues 51*a* and 51*b* are abutted with the hook portion 31. FIG. 4-D illustrates the state in which the slider 7 is advanced up to the transference position. In this position, the tongues 51*a* and 51*b* hold a loop (not shown) on their shoulder portions 57*a* and 57*b* in the state in which the tongues are diverged right and left by the needle hook 31.

Second, contrary to the foregoing, when the slider 7 is moved from its advanced position to its retracted position, the blades are guided, following the same track as that they followed when the slider is advanced. Specifically, the blades 50 are retracted, with their lower edges contacting with the bottom of the blade groove 32, so that they are guided back to their original retracted positions (FIG. 4-A) while they are gradually released from their own elastic deformation. If the blades' own elastic deformation is not released for any reason, so that the blades cannot return to their original retracted position, e.g., if fibrous dusts and the like get into the blade groove to hinder the movement of the blades in the blade groove, the upper surfaces 54*a* and 54*b* of the guiding portions 55*a* and 55*b* of the blades 50*a* and 50*b* are put into abutment with the guide surfaces 39*a* and 39*b* formed on the lower surfaces of the fork portions 38*a* and 38*b* formed on the needle hook member 30, and as such can allow the blades 50*a* and 50*b* to be lowered therealong to return them to the original retracted positions.

While in the embodiment illustrated above, the blades are fixedly connected to the slider body in such a manner the forefront portions of the blades are biased downwardly so that the tongues 51 can be accommodated in the blade groove 32 in their retracted positions, the blades may alternatively be connected to the slider body in such a manner that the blades are offset downwardly only to an extent corresponding to difference in height between the hook and a shank. When the blades thus biased or offset are fixedly connected to the slider body, the slider is advanced and retracted in the state in which the lower edges of the blades are always in abutment with the bottom of the blade groove and thereby the tongues are raised and guided to its lowered position, unless they have external influences caused by fibrous dusts and the like getting into the blade groove.

This connection of the blades to the slider body is not an essential feature of the present invention, however. The blades may alternatively be connected, for example, in such a manner that their connecting portions are journaled by a shaft on the slider body so as to be vertically swingable about the shaft, rather than in such a manner that the blades are fixedly mounted on the connecting portion of the slider body. In this alternation, the blades of the slider are supported by the bottom surface of the blade groove formed in the needle body and the guide surface of the fork portion, so that they will follow a specified track when advanced and retracted.

This construction that the tongues are allowed to be raised and retracted in association with the advancing motion and retracting motion of the slider can provide improvements in knitting conditions, such as reduction of a vertical interval between the throat portion of the needle body and a cheek portion of the same, reduction of frictional resistance of the needle against the loop held on the needle when advanced and retracted, and resultant reduction of the burden on the knitting yarn.

Figure 5:
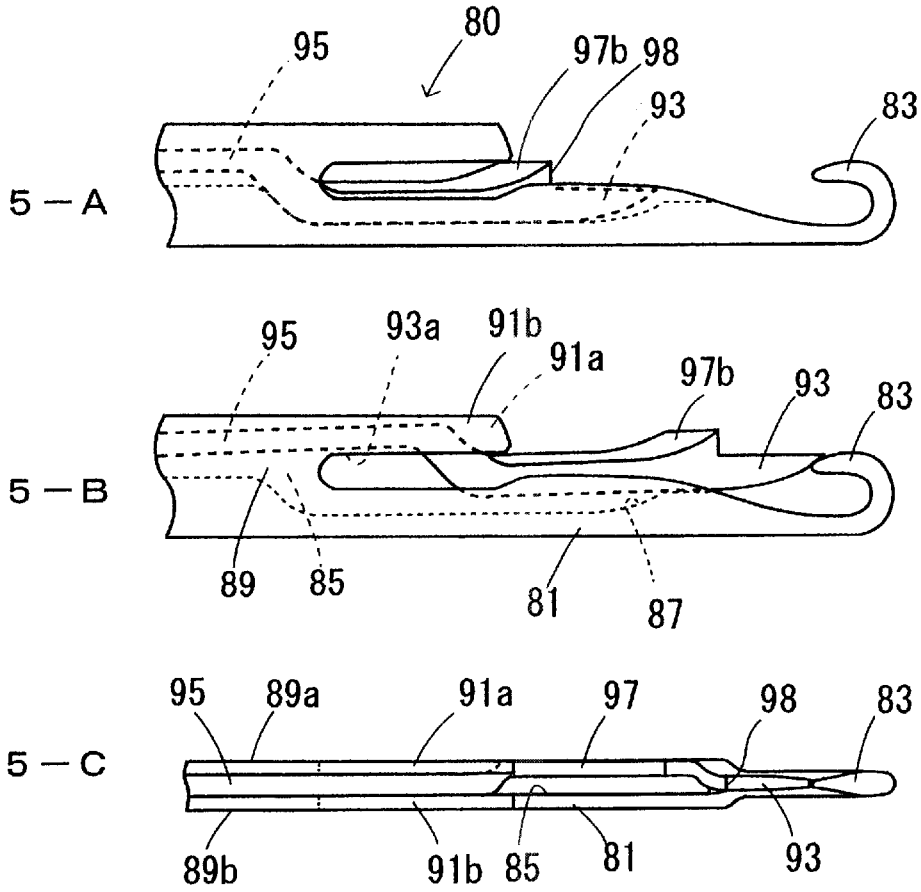
FIG. 5 illustrates another embodiment in which the guide mechanism of the present invention is applied to a compound needle.

Shown in FIG. 5 is another embodiment in which the guide mechanism of the present invention is applied to the compound needle disclosed by Japanese Patent Application Laid-open (Unexamined) No. Hei 3 (1991)-119160 as previously mentioned. FIG. 5-A illustrates the state that the hook is opened; FIG. 5-B illustrates the state that the hook is closed; and FIG. 5-C illustrates the compound needle 80 which is in the state shown in FIG.. 5-B when viewed from the top. A needle body 81 includes a hook portion 83, an accommodation groove 85 to accommodate a slider 95, and side walls 89*a* and 89*b* for forming the accommodation groove 85. The side walls have fork portions 91*a* and 91*b* extending forwardly. 87 denotes a cam surface, formed in the accommodation groove 85, for raising a tongue. On the other hand, a slider 95 includes the tongue 93, a shoulder portion 98 formed at a rear side of the tongue, and a guiding portion 97 formed at a rear side of the shoulder portion 98 and curved so that its upper surface confronts the lower surface of one fork portion 91*a*. The engagement of the fork portion 91*a* and the guiding portion 97 permits the slider 95 to be guided to its vertical position. In this embodiment, the other fork portion 91b can be omitted, because it does not form the guide mechanism.

Figure 6:
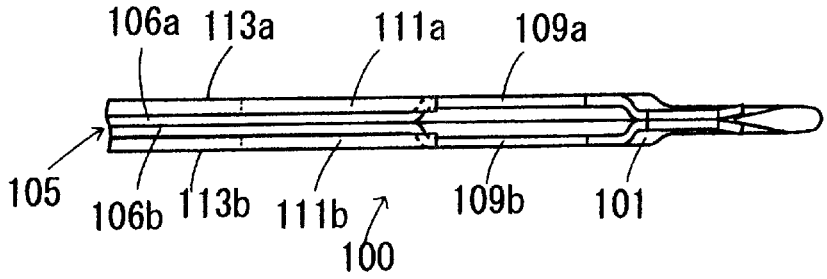
FIG. 6 illustrates a variant of FIG. 5 in which the guide mechanism of the present invention is applied to the compound needle.

FIG. 6 shows a variant of the compound needle shown in FIG. 5 and corresponds to FIG. 5-C. In this variant, a slider 105 is formed by blades 106*a* and 106*b* comprising two thin plates combined in an overlapped relation. Also, in order for guiding portions 109*a* and 109*b* to be engaged with and guided by the fork portions 111*a* and 111*b* formed on both sides of the needle body 101, the guiding portions 109*a* and 109*b* are formed by curving the engaging portions of the blades 106*a* and 106*b* with the fork portions 111*a* and 111*b* toward the side walls 113*a* and 113*b* of the needle body 101 at portions thereof on the slidably contacting side. The compound needle 100 thus constructed can be used as a slider needle.

This can produce the guide mechanism of the slider by a relatively simple working, such as a press working, without any need of a complex cutting work as in the prior art. In the embodiments shown in FIG. 5 and FIG. 6, the slider is guided by the fork portion of the needle body within the hole stroke of the slider's reciprocating motion.

While in the embodiments illustrated above, the needle body forming the compound needle was referred to as the first knitting member and the slider was referred to as the second knitting member, the guide mechanism of the present invention is of course applicable to other knitting members including a sinker and transfer jack fitted on the accommodation beds of the knitting machine, without limiting to the application to those knitting members.

CAPABILITIES OF EXPLOITATION IN INDUSTRY

As mentioned above, the knitting member of the present invention is so constructed that the second knitting member is formed to be curved outwardly so that the upper surface of the second knitting member can confront the lower surfaces of the fork portions formed on the side walls of the first knitting member. This can provide the result that when the second knitting member is retracted relative to the first knitting member, the curved portion of the second knitting member can be brought into abutment with the fork portion of the first knitting member to regulate the vertical position of the second knitting member to a specified position.

What is claimed is:

1. A knitting member guide mechanism comprising a first knitting member, which is accommodated in each of a number of knitting member accommodation grooves arranged side by side on an accommodation bed, so as to be freely advanced toward and retracted from a needle bed gap, and a second knitting member which is accommodated in an accommodation groove formed in the first knitting member to extend longitudinally of the first knitting member, so as to be movable relative to the first knitting member, wherein the first knitting member has a fork portion extending forwardly formed in an upper portion of at least one side wall of the first knitting member at an accommodation groove forming portion thereof where the accommodation groove for accommodating the second knitting member is formed, the second knitting member has a guiding portion formed to be curved outwardly so that an upper surface can confront a lower surface of the fork portion formed on the at least one side wall of the first knitting member, when the second knitting member is moved relative to the first knitting member, the guiding portion of the second knitting member is guided into a space formed under the fork portion of the first knitting member and supported by the fork portion during at least part of the relative movement.

2. The guide mechanism according to claim 1, wherein the lower surface of the fork portion is formed as a slanted cam surface declining rearwardly, so that when the second knitting member is retracted with respect to the first knitting member in the relative movement therebetween, the upper surface of the second knitting member is brought into abutment with the cam surface to lower the second knitting member.

3. A compound needle whose knitting members comprise a first knitting member and a second knitting member formed as a needle body having a hook at a front end and a slider having tongues at the slider front end, wherein an accommodation groove formed in the needle body has depth to accommodate the tongue therein when the slider is in a retracted position and raise and displace the tongue toward the hook when the slider is advanced, and wherein the accommodation groove has a guide surface formed on a lower surface of a fork portion provided in at least one side wall of the needle body, the slider is provided, on the slider upper surface, with a guiding portion which is formed to be curved outwardly so as to confront the guide surface of the fork portion, so that when the slider is retracted, the upper surface of the guiding portion of the slider is brought into engagement with the guide surface formed in the fork portion to guide the slider back to the retracted position.

4. The compound needle according to claim 3, wherein the slider comprises blades comprising two thin plates having tongues at their front ends, respectively, the blades are accommodated in the accommodation groove of the needle body, the fork portion is formed in each of the side walls of the needle body forming therein the accommodation groove, and the blades are formed to be curved toward the side walls of the needle body on the side on which the blades are slidably contactable with the side walls of the needle body, respectively, so that upper surfaces of the blades confront their respective lower surfaces of the fork portions.

5. The compound needle according to claim 4, wherein the blades are connected to the slider body supported on the needle body at top portions thereof.

6. The compound needle according to claim 5, wherein the blades are connected to the slider body in such a manner that front ends of the tongues are biased downwardly in the state in which the blades are accommodated in the accommodation groove of the needle body.

7. The guide mechanism according to claim 1, wherein the first knitting member includes a knitting needle.

* * * * *